US007434592B2

(12) United States Patent
Larson et al.

(10) Patent No.: US 7,434,592 B2
(45) **Date of Patent: *Oct. 14, 2008**

(54) ERGONOMIC COLLAPSIBLE CRUTCH

(75) Inventors: Brad Larson, North Logan City, UT (US); Ken Lester, North Logan City, UT (US); Clair Nilson, Logan City, UT (US); Eric Nilson, Providence, UT (US); Mark Nilson, Providence, UT (US)

(73) Assignee: Millennial Medical Equipment, L.L.C., Logan, UT (US)

( * ) Notice: Subject to any disclaimer, the term of this patent is extended or adjusted under 35 U.S.C. 154(b) by 21 days.

This patent is subject to a terminal disclaimer.

(21) Appl. No.: 10/960,823

(22) Filed: Oct. 7, 2004

(65) Prior Publication Data

US 2005/0076941 A1 Apr. 14, 2005

Related U.S. Application Data

(63) Continuation-in-part of application No. 10/461,578, filed on Oct. 10, 2003, now Pat. No. 7,104,271.

(51) Int. Cl.
*A61H 3/02* (2006.01)
*A45B 9/02* (2006.01)

(52) U.S. Cl. ..... 135/73; 135/72; 135/74; 135/82; 482/67

(58) Field of Classification Search ..... 135/65, 135/68, 71–77, 82; 248/155; 272/70.1–70.3; 482/49, 67, 69, 148
See application file for complete search history.

(56) References Cited

U.S. PATENT DOCUMENTS

| | | | |
|---|---|---|---|
| 26,829 | A | 1/1860 | Bickel |
| 2,690,188 | A | 9/1954 | Goddard |
| 2,741,255 | A | 4/1956 | Neptune |
| 3,133,551 | A | 5/1964 | Murcott |
| D204,849 | S | 5/1966 | Thomas et al. |

(Continued)

FOREIGN PATENT DOCUMENTS

| | | |
|---|---|---|
| FR | 371.291 | 3/1907 |
| GB | 2 340 402 A | 2/2000 |
| JP | 2001-353010 | 12/2001 |
| JP | 2003 62021 | 3/2003 |

OTHER PUBLICATIONS

Thomas Fetterman, Inc., "Folding Underarm Travel Crutches", item No. 825, http://www.fetterman-crutches.com., pp. 1-2, copy right 1996-2004.*

(Continued)

*Primary Examiner*—Winnie Yip
(74) *Attorney, Agent, or Firm*—Craig Metcalf Kirton & McConkie

(57) ABSTRACT

An ergonomic collapsible crutch for providing assistance with ambulatory movement of a user, the crutch including a supporting member having an underarm support surface and a hand grip portion, a gripping pad disposed remotely from the underarm support surface generally along a vertical axis and connected to the supporting member to provide stability and grip on surfaces of a walking environment, and a hand grip attached to the hand grip portion of the supporting member so that the handgrip extends from the supporting member at an angle from the vertical axis ranging from about 85° to about 60° and from about 95° to about 120°. The ergonomic collapsible crutch may also include a shock absorbing device and buttons for adjusting the height of the crutch as well as the position of the hand grip. The hand grip may also be ergonomically contoured for improved use by a user.

4 Claims, 12 Drawing Sheets

U.S. PATENT DOCUMENTS

| | | | |
|---|---|---|---|
| 3,335,735 | A | 8/1967 | Colegrove et al. |
| 3,517,678 | A | 6/1970 | Gilsdorf |
| 3,635,233 | A | 1/1972 | Robertson |
| 3,947,140 | A | 3/1976 | Thomas |
| 4,184,503 | A | 1/1980 | Nakajima |
| 4,253,478 | A | 3/1981 | Husa |
| 4,763,680 | A | 8/1988 | Acosta, Sr. |
| 4,787,405 | A | 11/1988 | Karwoski |
| 4,869,280 | A | 9/1989 | Ewing |
| 4,958,651 | A | 9/1990 | Najm |
| 5,038,811 | A | 8/1991 | Gilmore |
| 5,138,058 | A | 8/1992 | Geisen et al. |
| 5,139,040 | A | 8/1992 | Kelly |
| 5,201,334 | A | 4/1993 | Tseng |
| 5,325,879 | A | 7/1994 | Burns |
| 5,331,989 | A | 7/1994 | Stephens |
| 5,458,143 | A | 10/1995 | Herr |
| 5,606,985 | A | 3/1997 | Battiston et al. |
| 5,628,335 | A | 5/1997 | Free |
| 5,671,765 | A | 9/1997 | Hagberg, Jr. |
| 5,673,719 | A | 10/1997 | Shofner |
| 5,711,334 | A | 1/1998 | Roux |
| 5,720,474 | A | 2/1998 | Sugiyama |
| 5,725,005 | A | 3/1998 | Yamasaki et al. |
| 5,771,910 | A | 6/1998 | Kluttz |
| 5,860,439 | A | 1/1999 | Ostertag |
| 5,924,434 | A | 7/1999 | Cato, III |
| 6,055,998 | A | 5/2000 | Bader |
| 6,164,305 | A | 12/2000 | Herman |
| 6,286,529 | B1 | 9/2001 | Olivera |
| 6,378,541 | B1 | 4/2002 | Matthews |
| 6,537,117 | B1 | 3/2003 | Larson et al. |
| 2001/0027802 | A1 | 10/2001 | McGrath |
| 2001/0032662 | A1 | 10/2001 | Battiston |
| 2003/0098051 | A1 | 5/2003 | Fismer |
| 2004/0025926 | A1 | 2/2004 | Gin et al. |
| 2004/0035453 | A1 | 2/2004 | McGrath |
| 2004/0250845 | A1 | 12/2004 | Rudin et al. |

OTHER PUBLICATIONS

Thomas Fetterman, Inc., Fetterman Litestix, Titanium Custom Shepherds Crutch, http://www.fetterman-crutches.com/crutchescanes/shepardT.html, pp. 1-2, Oct. 4, 2004.

"Shock Absorbing Crutch," Allegro Medical, http://www.allegromedical.com/walkers_canes_crutches/crutches, pp. 1-5, printed Jun. 25, 2004.

"The Design of a Compliant Composite Crutch," Dorota Shortell et al., Department of Veterans Affairs, Journal of Rehabilitation Research and Development, vol. 38, No. 1, pp. 23-32Jan./Feb. 2001.

* cited by examiner

ERGONOMIC COLLAPSIBLE CRUTCH

CROSS-REFERENCED RELATED APPLICATIONS

This application is a continuation-in-part of prior application Ser. No. 10/461,578, filed Oct. 10, 2003 now U.S. Pat. No. 7,104,271 entitled "ERGONOMIC COLLAPSIBLE CRUTCH" invented by Brad J. Larson, Ken Lester, Clair Nilson, Eric Nilson, and Mark Nilson.

BACKGROUND OF THE INVENTION

The present inventions are directed to medical devices for ambulatory care and more particularly ergonomic crutches.

A crutch is generally thought of as a medical device that is used to support all or part of a patient's body weight. A crutch has traditionally been made of wood or metal, and is ordinarily long enough to reach from a patient's underarm to the walking surface. There is typically a concave surface fitting underneath the arm, and a cross bar for the hand, both used for supporting the body weight. Crutches may be used by a patient for only a few days or, in some instances, a lifetime. Crutches have caused or led indirectly to multiple injuries and disorders despite their ability to transfer weight. In addition, each repetition of an injurious action can produce microtrauma to the tissues and joints of the body. Although the human body has enormous self-repair abilities, continued exposure to such activities can outweigh these abilities, which then results in injury.

The injuries resulting from crutch use are in part due to the fact that patients overly rely upon the underarm portion to support the body weight. Most crutch designs have not taken into consideration the appropriate contour of the axilla. This has resulted in nerve injuries varying from neuropraxia to complete paralysis of the arm. In addition, the hand grip is rarely contoured to fit a patient's palm. The general construction and design of crutch hand grips does not provide the correct ergonomic orientation between the wrist and forearm even though padding may be present. Failure to achieve correct alignment and padding in the palmar area can result in disorders of wear and tear, including overuse syndromes, repetitive strain injuries, musculoskeletal injuries, and compressive neuropathies. Common injuries resulting in such usage include: carpal tunnel syndrome, wrist tendonitis, medial or lateral elbow epicondylitis, and rotator cuff muscle strains and tears. These disorders appear to be more common in the chronic crutch user, and are the result of repeated stresses on a particular musculoskeletal area.

Crutches have traditionally imported a fixed-length frame having a concave cushioned upper end for placement under the arm, a horizontally-directed rigid handle that extends between two bows that act primarily to carry the weight of a patient, and a lower end configured to contact the ground. Shock absorbing devices have been placed on crutches to lessen the impact to a patient as the body weight is transferred to the walking surface. An added benefit of a shock absorbing device is to assist a patient on uneven ground, as well. Different crutch ends have been designed to provide contact between the crutch and the walking surface. However, an appropriate gripping surface to decrease friction is necessary to prevent the crutch from sliding or slipping. A distal end that not only grips the surface but angulates with the movement of the crutch is necessary to assure full contact.

While various modifications have been attempted, there presently does not exist a crutch that incorporates the appropriate ergonomic structure in a light-weight, sure gripping, user friendly, shock absorbing, and collapsible format.

BRIEF SUMMARY OF THE INVENTION

The present inventions meet the above-described needs and others. Specifically the present inventions provide an ergonomically designed shock absorbing collapsible crutch to facilitate walking and minimize injurious impact to a patient.

The crutch has one supporting member in place of two for easier usage and transport. The underarm support surface located toward the proximal end of the supporting member may have interchangeable cushioning pads and is contoured to fit underneath the axilla comfortably. The hand grip located toward the distal end of the supporting member has the appropriate contours for the palm of the hand and ergonomic angulation between the wrist and forearm. An alignment rib connects the supporting member to an adjustable portion to provide support, lengthening and collapsibility. Both the proximal and distal ends of the alignment rib have a snap button to connect to the supporting member and adjustable portion, respectively. A shock absorbing device may be connected to the distal end of the adjustable portion to assist in ambulating over uneven surfaces and to provide a cushioning effect. The shock absorbing device may use a spring to cushion the impact of ambulation and the use of the crutch. The spring of the shock absorbing device stores the energy of the impact which can be used to assist a user in her forward ambulation. The distal end of the crutch has a gripping pad that provides appropriate friction between the crutch and the walking environment. It also angulates to provide full contact with the ground throughout the stance phase of the gait cycle. The crutch is collapsible to approximately half of its length allowing for ease in storage and transportation.

The crutch may be made of wood, metal, plastic, or composite material such as carbon fiber with an epoxy matrix. The crutch, therefore, may be manufactured by any combination of methods such as machining, stamping, casting, molding, filament winding, extrusion, etc.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the ergonomic collapsible crutch of the present invention, as represented in FIGS. 1 through 18, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The term "abutting" refers to items that are in direct physical contact with each other, although the items may not be attached together. The terms "integrally formed" refer to a body that is manufactured integrally, i.e., as a single piece, without requiring the assembly of multiple pieces. Multiple parts may be integrally formed with each other if they are formed from a single work piece.

Figure 1:
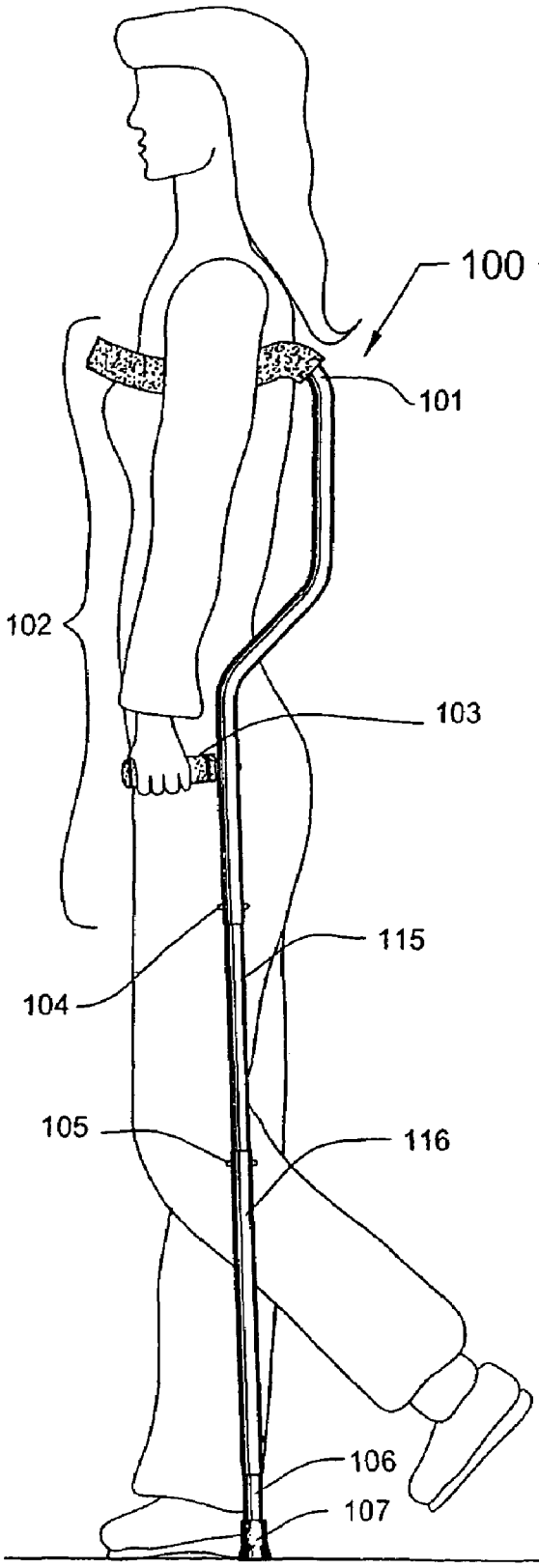
FIG. 1 is a side elevation view of an embodiment of the ergonomic collapsible crutch placed in the forward orientation with respect to a patient.

FIG. 1 illustrates an embodiment of an ergonomic collapsible crutch 100 placed in the forward orientation with respect to a patient. A patient is intended to include any user of the device. The crutch 100 includes an underarm support surface 101, a supporting member 102, a hand grip 103, an alignment rib 115, an adjustable portion 116, a shock absorbing portion 106, and a gripping pad 107. The supporting member 102 and adjustable portion 116 each have dual snap buttons 104 and 105, respectively.

The underarm support 101 located toward the proximal end of the supporting member has interchangeable cushioning pads. The underarm support 101 may be padded with an elastomeric material such as EVA, urethane foam, neoprene foam, PVC, natural rubber, cork or any other possible materials. The hand grip 103 is located toward the distal end of the supporting member 102 and has the appropriate contours and ergonomic angulation to fit the palm and align the wrist. The hand grip 103 may be fabricated of elastomeric material such as EVA, urethane foam, neoprene foam, PVC, natural rubber, cork or any other possible materials. An alignment rib 115 connects the supporting member 102 to an adjustable portion 116 to provide support, height adjustment and collapsibility.

The supporting member 102, alignment rib 115 and adjustable portion 116 may be fabricated of metal such as aluminum, steel, or titanium, and are formed in a generally hollow cylindrical shape. The internal and external diameter of the supporting member 102, alignment rib 115 and adjustable portion 116 can be of varying dimensions to accommodate a patient's needs and to provide for the pieces of the crutch to fit together. For example, a pediatric patient may utilize a crutch with a smaller external diameter than an adult patient. A shock absorbing portion 106 may be used at the distal end of the adjustable portion 116 to assist in ambulating over uneven surfaces and to provide a cushioning effect. The distal end of the crutch has a gripping pad 107 that provides appropriate friction between the crutch 100 and the walking environment. The gripping pad 107 may be formed of an elastomeric material such as EVA, urethane foam, neoprene foam, PVC, natural rubber, cork or any other possible materials.

Figure 2:
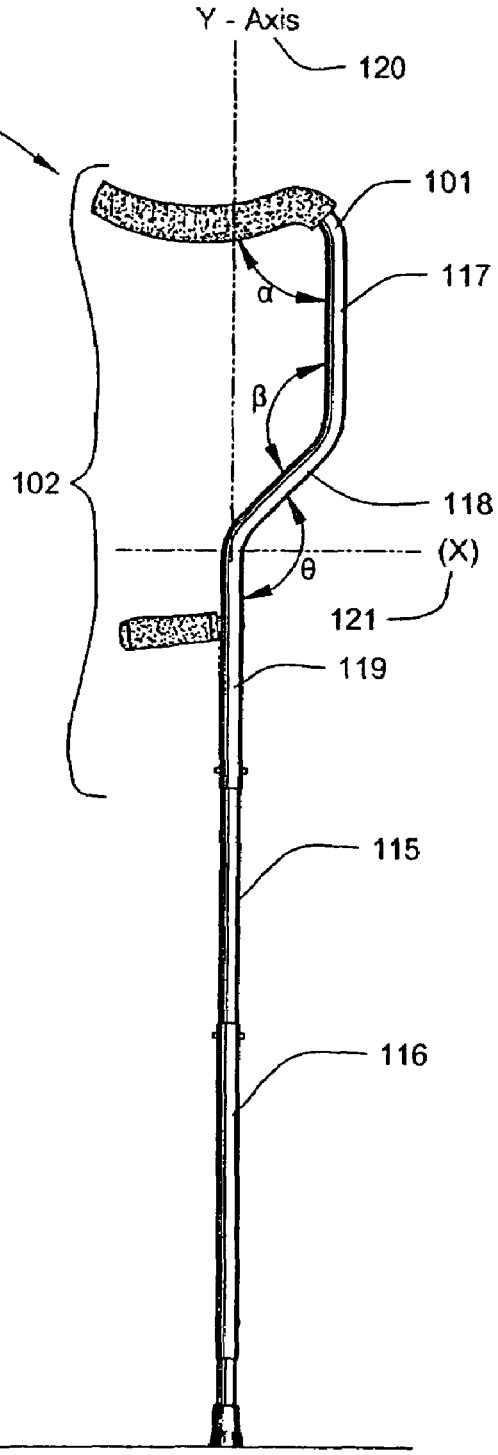
FIG. 2 is a side elevation view of an embodiment of the ergonomic collapsible crutch.

FIG. 2 is a side perspective view of an embodiment of a crutch 100 that has one supporting member 102 for ease of usage and carrying. A vertical axis or y-axis 120 is drawn along the center of the alignment rib 115 and adjustable portion 116. A horizontal line or x-axis 121 is drawn perpendicular to the y-axis 120 and transects the supporting member 102. The supporting member 102 consists of four sections: the underarm support 101, the stabilizing portion 117, the middle bend portion 118, and the hand grip portion 119.

The underarm support 101 is generally parallel to the x-axis 121 and it is contoured to fit the underarm of a patient. The length of the underarm support 101 extends considerably beyond either side of a patient's arm. The underarm support 101 has a concave curvature along the top edge and a convex curvature along its underside. The concave curve along the top edge is designed to prevent slippage and provide comfort and stability to a patient.

The stabilizing portion 117 is generally parallel to the y-axis 120. The stabilizing portion 117 is configured to be at an angular orientation a with respect to the underarm support 101 in the range of 45° to 135°. The crutch 100 embodiment of FIG. 2 has an angular orientation $\alpha$ of approximately 90°.

The middle bend portion 118 projects from the stabilizing portion 117 in a downward direction toward the y-axis 120 such that the x-coordinate of the distal end of the middle bend portion 118 is close to the x-coordinate of the proximal end of the hand grip portion 119 in FIG. 2. In one embodiment depicted in FIG. 2, the x and y coordinates of the distal end of the middle bend portion 118 are approximately (0,0). The middle bend portion 118 is configured to be at an angular orientation β with respect to the stabilizing portion 117 in the range of 90° to 180°. In one embodiment of the ergonomic collapsible crutch 100, the angular orientation β is approximately 135°.

The hand grip portion 119 projects from the distal end of the middle bend portion 118 in a generally vertical direction. In one embodiment of the ergonomic collapsible crutch 100, the hand grip portion 119 directly follows the y-axis 120 such that the x-coordinate of the proximal end of the hand grip portion 119 is close to the x-coordinate of the distal end of the hand grip portion 119. In one embodiment as depicted in FIG. 2, the x coordinate of the entire hand grip portion 119 is approximately zero. The hand grip portion 119 is configured to be at an angular orientation θ with respect to the middle bend portion 118 in the range of 90° to 180°. In one embodiment of the ergonomic collapsible crutch the angular orientation θ is approximately 135° such that the angular orientation β is approximately the same as the angular orientation θ. The hand grip portion 119 extends beyond the hand grip 103 to provide dual snap buttons for the folding mechanism 104 of the crutch allowing for collapsibility.

The alignment rib 115 provides the connection between the supporting member 102 via the hand grip portion 119 and the adjustable portion 116. The hand grip portion 119 of the supporting member 102 includes dual snap buttons 105 to accommodate patients of varying heights. Alternative devices may be used as a latching mechanism instead of the illustrated dual snap buttons 105. For example, a single pin radially biased outward would be sufficient. In one embodiment of the ergonomic collapsible crutch the adjustable portion 116 is connected to a shock absorbing portion 106 to lessen impact on a patient. Additionally, a gripping pad 107 is at the end of the crutch to provide stability and grip on uneven or slick surfaces.

Figure 3:
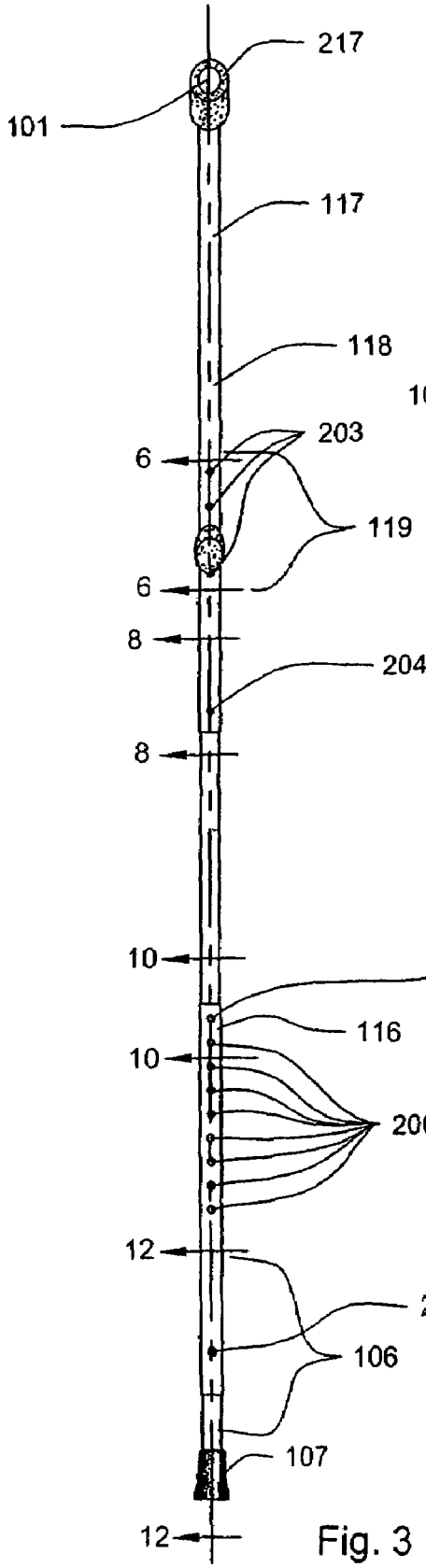
FIG. 3 is front elevation view of an embodiment of the ergonomic collapsible crutch.
Figure 4:
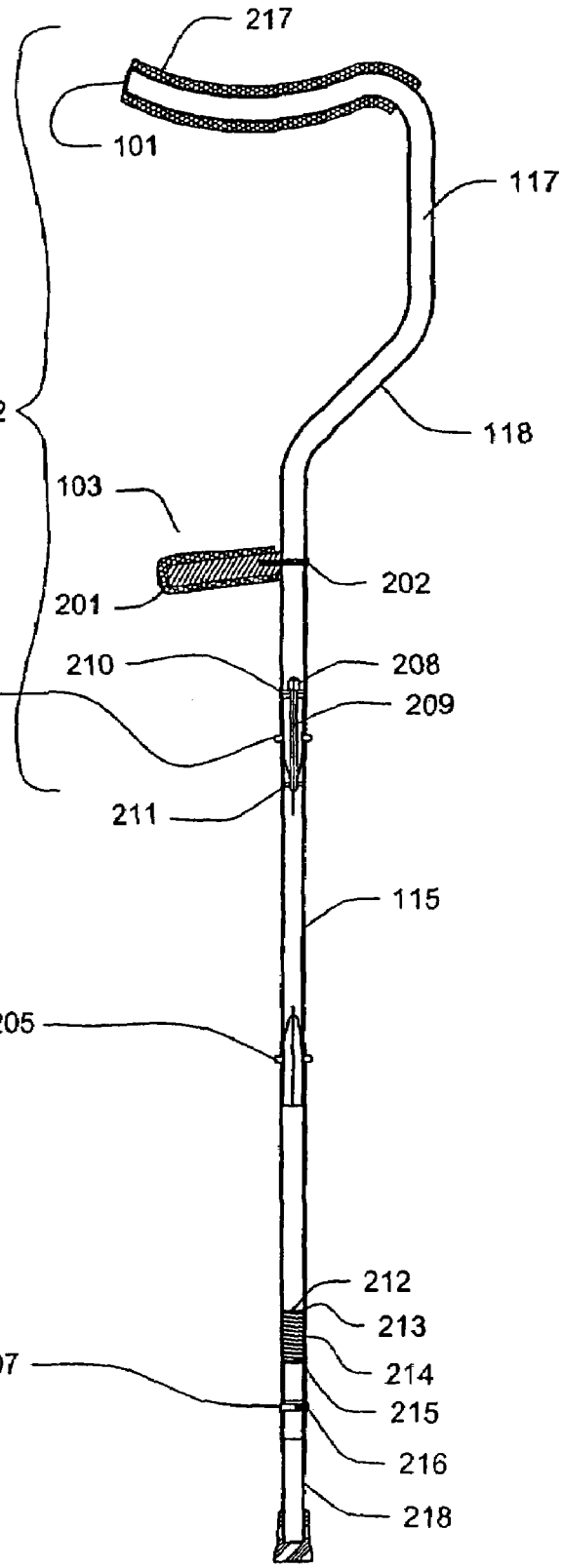
FIG. 4 is a cross-sectional side elevation view of an embodiment of the ergonomic collapsible crutch.

FIGS. 3 and 4 illustrate the underarm pad 217, hand grip portion 119, the two snap assembly of the folding mechanism 204, the two snap assembly of the height adjustment mechanism 205, the shock absorbing portion 106 and the gripping pad 107.

The underarm pad 217 may be generally cylindrical in shape and may be fabricated with an elastomeric material such as EVA, urethane foam, neoprene foam, PVC, natural rubber, cork or any other possible materials. The exterior diameter of the underarm pad 217 may be custom designed to fit a patient's desired thickness and density. The interior diameter of the underarm pad 217 may also be custom designed to fit the diameter of the underarm support 101. In addition, the underarm pad 217 is removable/replaceable in the event an alternative material, thickness, diameter and/or density is desired. The underarm support 101 is a portion of the supporting member 102 and is connected to the hand grip portion 119, via the stabilizing portion 117 and the middle bend portion 118.

The hand grip portion 119 has a series of diametrically opposed hand grip adjustment apertures 203 to allow the hand grip 103 to be placed in a variety of positions to accommodate height adjustment and a patient's desired orientation of the crutch. The hand grip portion 119 is further described and illustrated in FIGS. 5 through 7. The distal end of the hand grip portion 119 extends beyond the hand grip 103 to provide dual snap buttons for the folding section 104 of the crutch allowing for collapsibility. The dual snap buttons for the folding mechanism 204 are designed to release the crutch into two connected pieces by disengaging the hand grip portion 119 from the alignment rib 115. Alternative devices may be used as a latching mechanism instead of the illustrated dual snap buttons 104. For example, a single pin radially biased outward would be sufficient. The folding mechanism is further described in illustrated in FIGS. 9 and 10. The alignment rib 115 engages with the adjustable portion 116 via dual snap buttons 205 for height adjustment. The adjustable portion 116 has a series of diametrically opposed apertures 206 allowing for a customized crutch length to accommodate varying patient heights.

Figure 5:
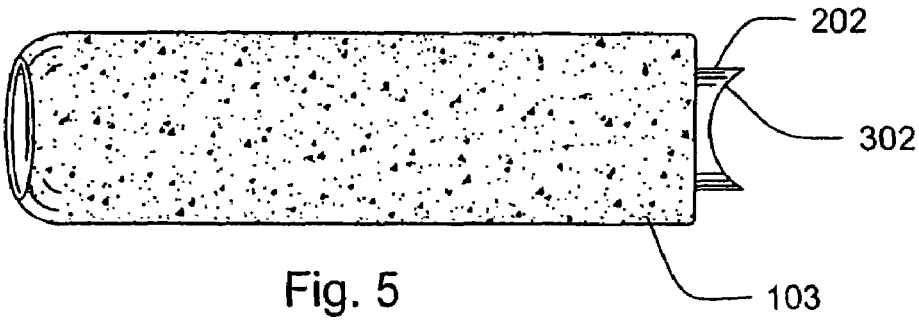
FIG. 5 is a side elevation view of an embodiment of the hand grip portion.
Figure 7:
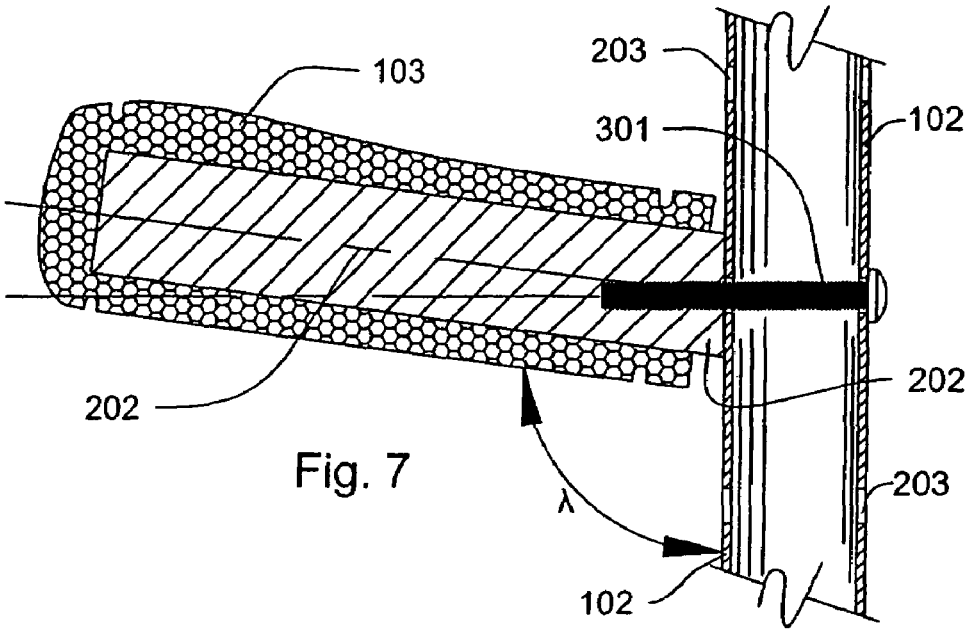
FIG. 7 is a cross-sectional side view of an embodiment of the hand grip in the upward position.
Figure 6:
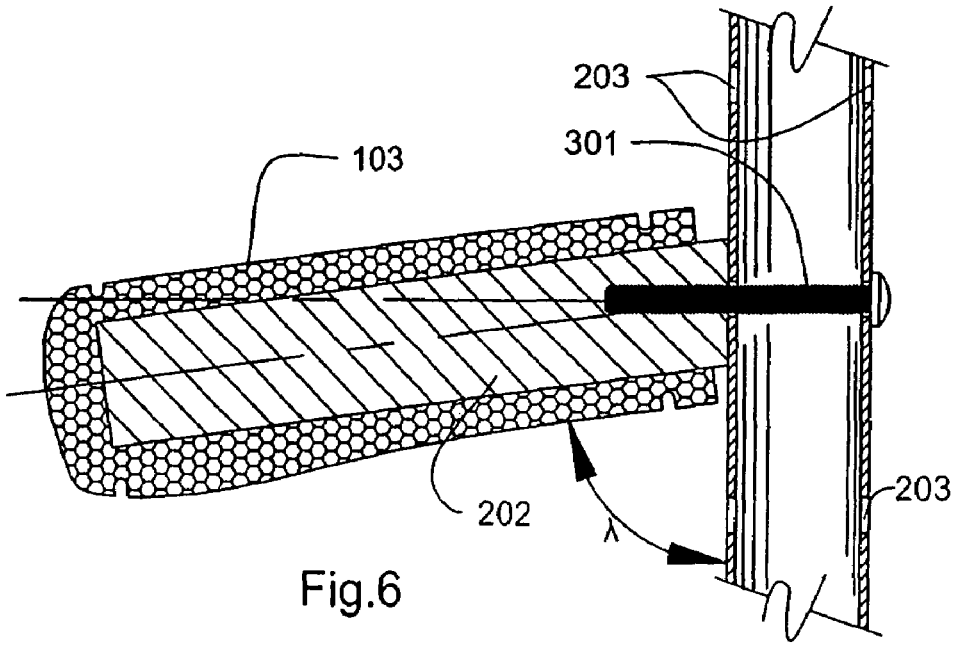
FIG. 6 is a cross-sectional side elevation view of an embodiment of the hand grip in the downward position.

FIGS. 5 through 7 provide alternative embodiments of a hand grip 103 for use on an ergonomic collapsible crutch. The hand grip 103 is adjustable to maintain the wrist of a patient in the neutral position, which position has been described as a line passing though the middle of the third metacarpal being parallel to a line passing through the middle of the radius. The adjustability of hand grip 103 allows for easier grip, decreased stress and decreased risk of injury to the wrist. The ergonomic design of the hand grip 103 encourages spreading of the force load from grasping forces over as large an area as possible.

The hand grip 103 is connected to the hand grip portion 119 of the supporting member 102 via a hand grip shaft 202. In one embodiment of the ergonomic collapsible crutch, the hand grip 103 is secured to the supporting member 102 via a machine screw 301 that extends through a set of hand grip adjustment apertures 203.

The hand grip 103 may be of varying diameters to accommodate the palm of a patient. In one embodiment of the ergonomic collapsible crutch, the hand grip 103 is about 1 cm smaller than a patient's inside grip diameter. The pressure of the hand grip 103 on the hand should be distributed over the fat pads of the hands. The contour of the hand grip 103 corresponds with the curve of the transverse palmar arch and the natural palmar curve of the fingers as they flex toward the palm.

The length of the hand grip 103 should be long enough to evenly distribute the grasping forces over the palm of the hand. A grip with a length in the range of about 4 to about 5 inches or from about 10 to about 12 centimeters provides sufficient area to spread the grasping force over the palm of an average adult patient. However, the length of the hand grip 103 may be customized to the palm of any patient.

Figure 8:
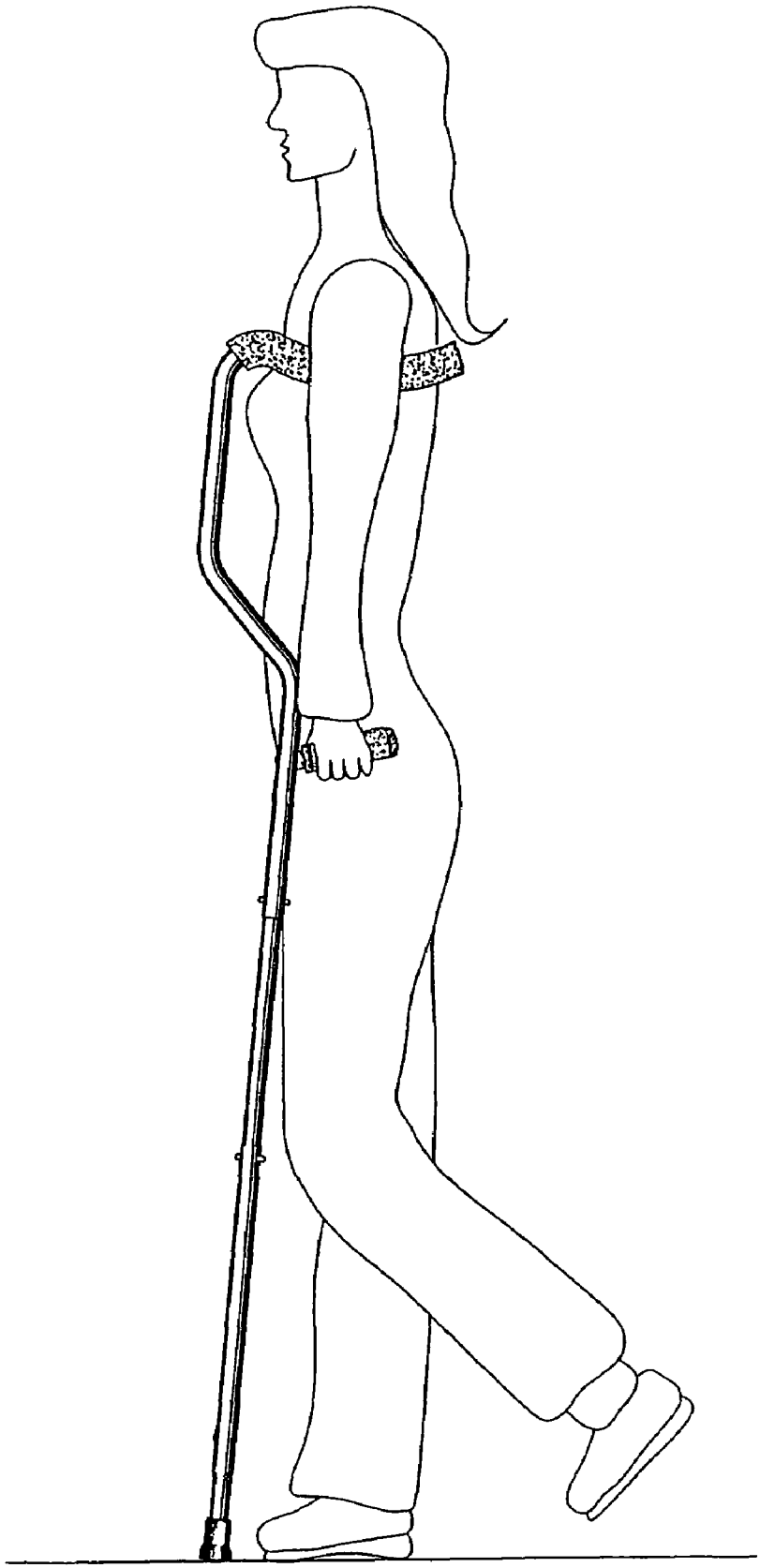
FIG. 8 is a side elevation view of an embodiment of the ergonomic collapsible crutch placed in the reverse orientation with respect to a patient.

The hand grip 103 is oriented to maintain the wrist in a neutral position throughout a patient's walking motion. The neutral position is generally maintained by keeping a patient's third metacarpal generally aligned with his radius. Therefore, the hand grip 103 is angled outwardly from the y-axis at an angle λ from the x-axis allowing for a patient's third metacarpal to be more generally aligned with his radius. The edge of the hand grip shaft 302 that contacts the supporting member 102 may be manufactured to provide complete contact such that when the hand grip 103 is at an angle λ there is little to no gap between the edge of the hand grip shaft 302 and the supporting member 102. The angle λ is determined by a variety of factors including the orientation of the crutch. The crutch may be used in the forward orientation as illustrated in FIG. 1 or the reverse orientation as illustrated in FIG. 8. In addition, one or two crutches may be used by a patient. A crutch placed in the forward orientation with respect to a patient, as illustrated in FIGS. 1 and 6, requires an angle λ ranging from about 90° to about 45°. This range is sufficient to at least partially align the third metacarpal with the radius and place the wrist in the neutral position. Additionally, one embodiment of the ergonomic collapsible crutch has an angle λ ranging from about 80° to about 60°. An angle λ in the range from about 75° to about 65° accommodates most adult patients.

A crutch placed in the reverse orientation with respect to a patient, as illustrated in FIGS. 7 and 8 requires an angle λ ranging from about 90° to about 135°. This range is sufficient to at least partially align the third metacarpal with the radius and place the wrist in the neutral position. Additionally, one embodiment of the ergonomic collapsible crutch has an angle λ ranging from about 100° to about 120°. An angle λ in the range from about 105° to about 115° accommodates most adult patients.

Figure 9:
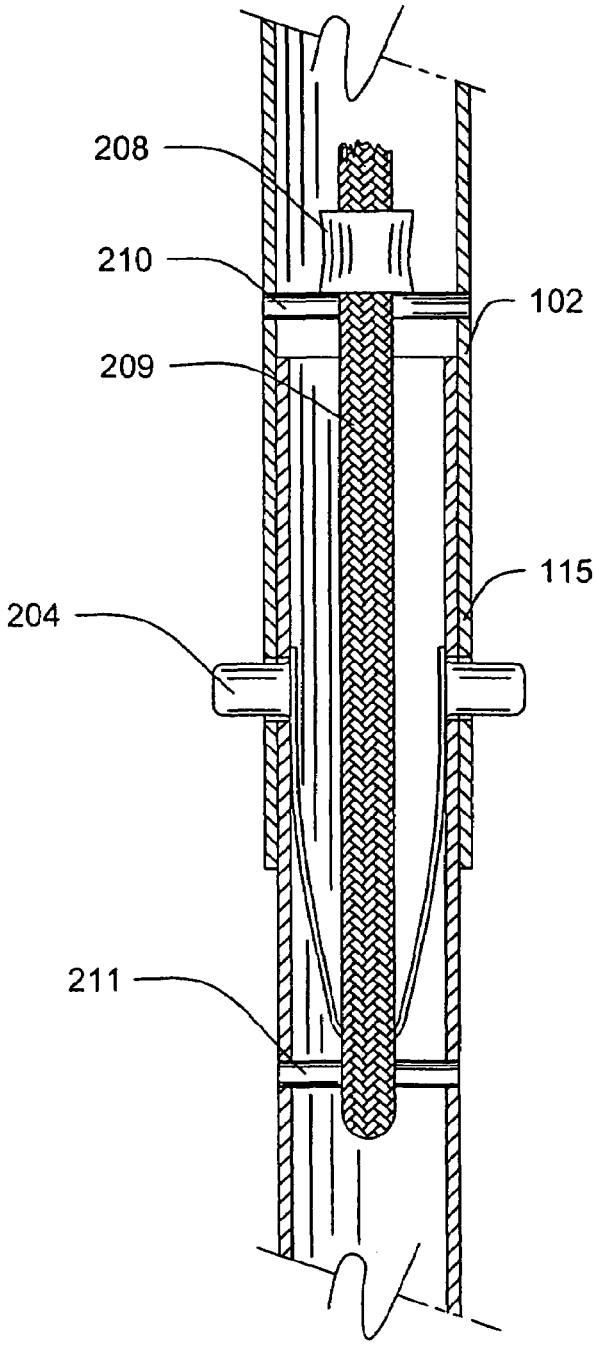
FIG. 9 is a cross-sectional side elevation view of an embodiment of the crutch folding mechanism.
Figure 10:
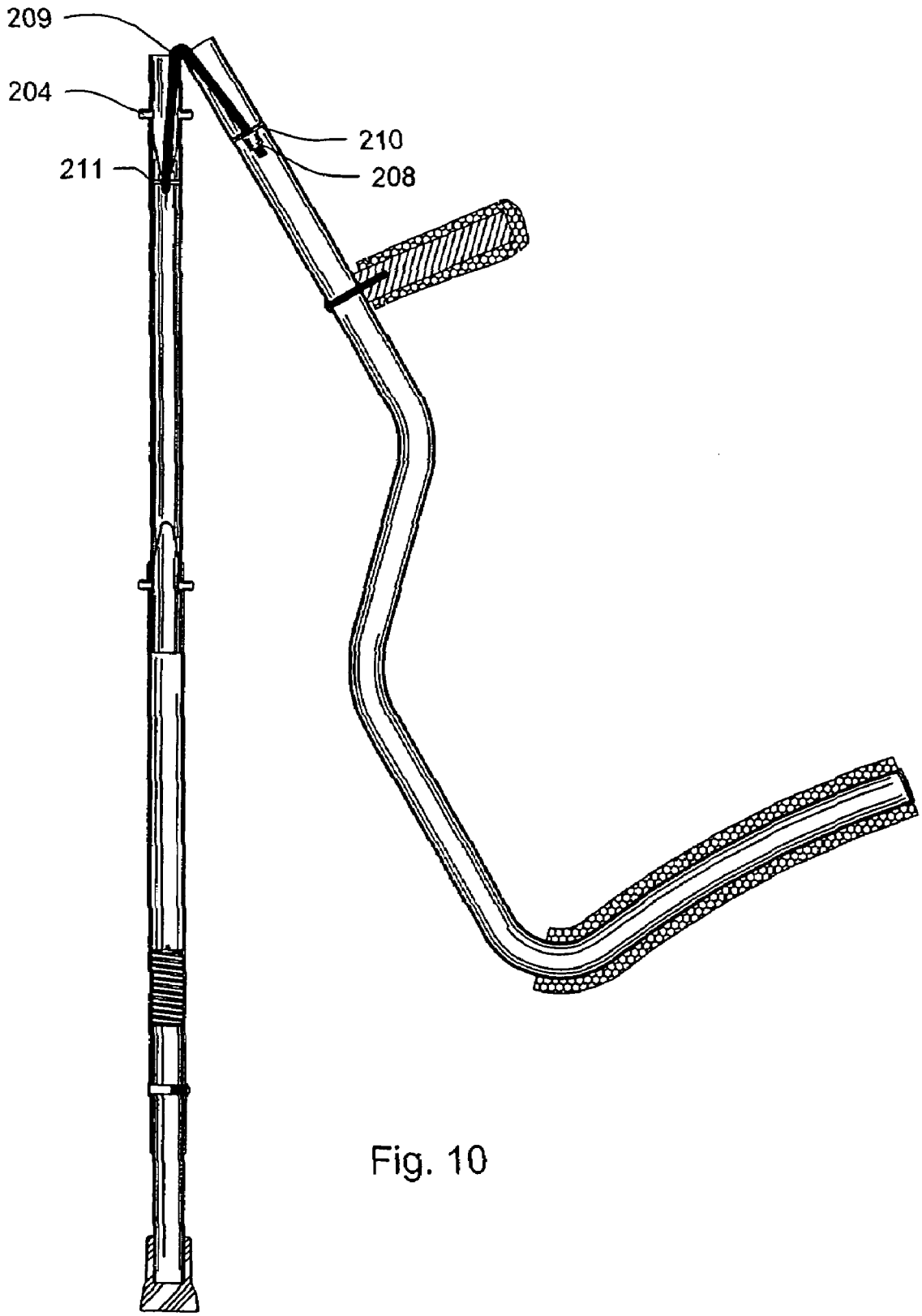
FIG. 10 is a cross-sectional side elevation view of an embodiment of the crutch in a partially folded position.
Figure 12:
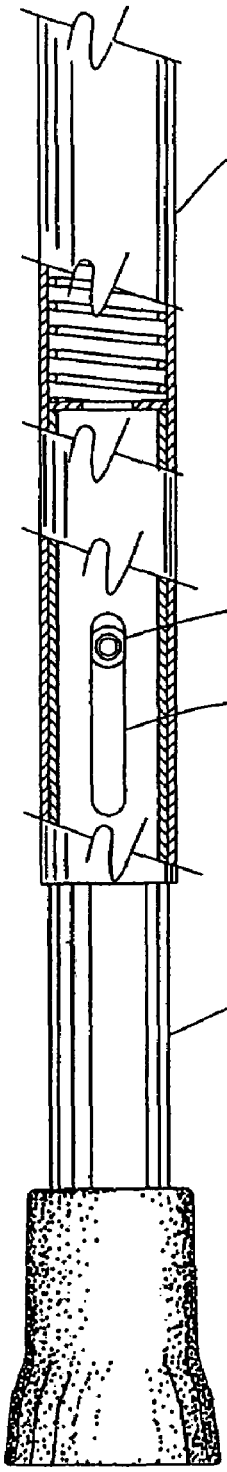
FIG. 12 is a cross-sectional side elevation view of an embodiment of the crutch shock absorbing mechanism.

FIGS. 9 and 10 illustrate an embodiment of the crutch folding mechanism. The ergonomic collapsible crutch is collapsible to approximately half or less of its length allowing for ease in storage and transportation. In one embodiment, the crutch can be disengaged in preparation for collapsing by depressing both of the dual snap buttons 204 while pulling the supporting member 102 and the alignment rib 115 in opposite directions. Once the crutch is disengaged, an elastic cord 209 provides continued attachment and flexibility between the supporting member 102 and the alignment rib 115, such that the crutch may be folded. The elastic cord 209 extends through a portion of the interior of the supporting member 102 and alignment rib 115. The elastic cord 209 may be attached to the supporting member 102 via a supporting member elastic retaining pin 210. A clinch ring 208 may be used to secure the elastic cord 209 to the supporting member elastic retaining pin 210. A similar mechanism may be used to attach the elastic cord 209 to the alignment rib 115, such that an alignment rib elastic retaining pin 211 secures the elastic cord 209. Alternative means of attachment of the elastic cord and folding of the crutch are possible.

Figure 11:
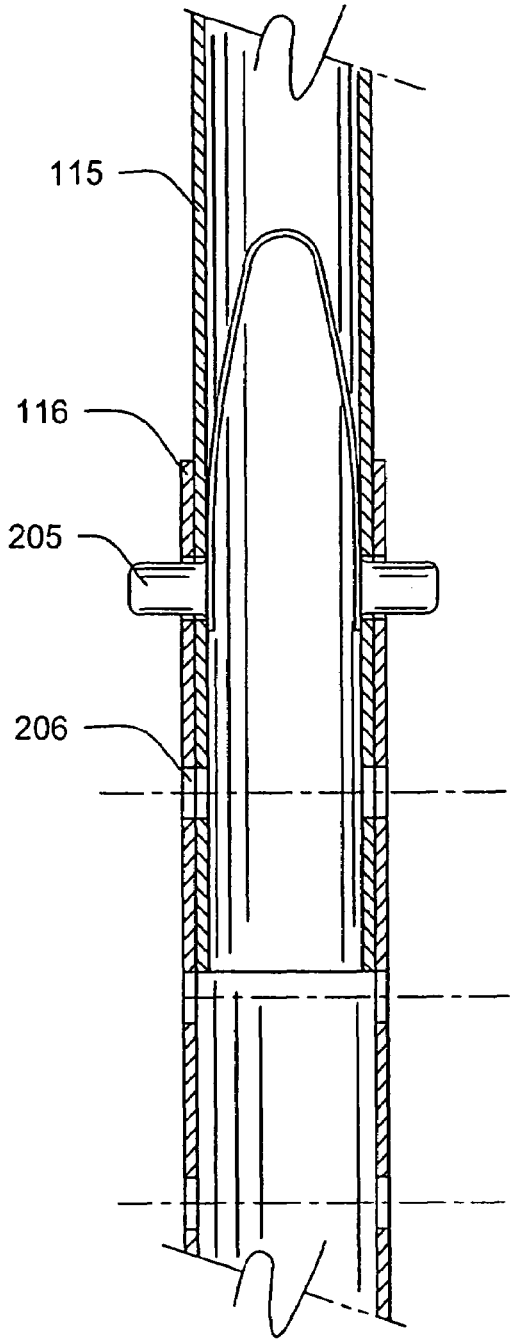
FIG. 11 is a cross-sectional side elevation view of an embodiment of the crutch height adjustment mechanism.

In one embodiment, the height of the crutch may be adjusted by providing an adjustable portion 116 as shown in FIG. 11. Such adjustment can include but is not limited to dual snap buttons 205. The crutch height is adjusted by depressing the buttons 205 causing the alignment rib 115 to be released from the adjustable portion 116. This allows the alignment rib 115 to be telescoped into or out of the adjustable portion 116. Once the crutch is at the desired length, the alignment rib 115 can be locked into place by allowing the dual snap buttons 115 to extend through a set of diametrically opposed apertures 206. Multiple crutch heights are accommodated for by multiple sets of these apertures 206. The crutch may be extended of contracted to a variety of lengths to accommodate children and adults. Additionally, the length of the alignment rib 115 may be customized to provide a desired crutch length.

Figure 13:
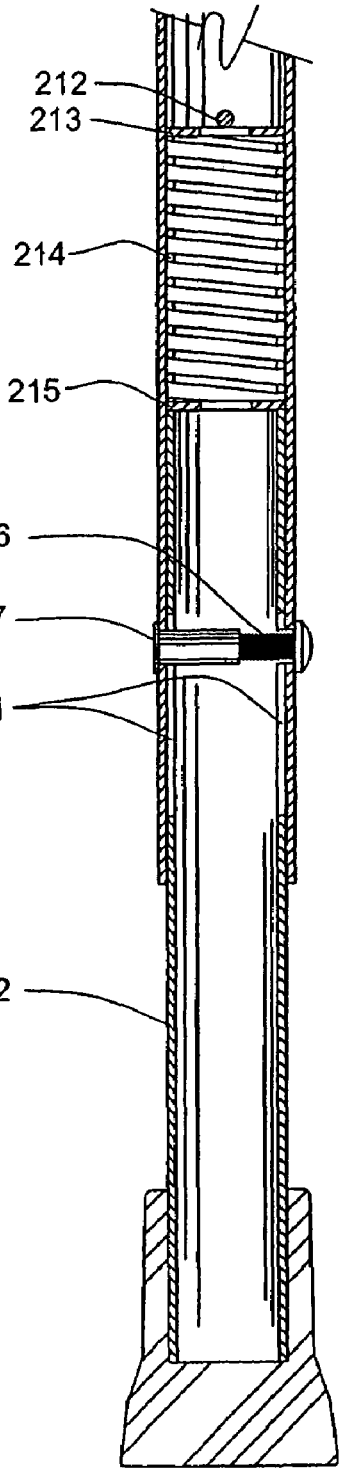
FIG. 13 is a cross-sectional side elevation view of an embodiment of the crutch shock absorbing mechanism in the relaxed position.
Figure 14:
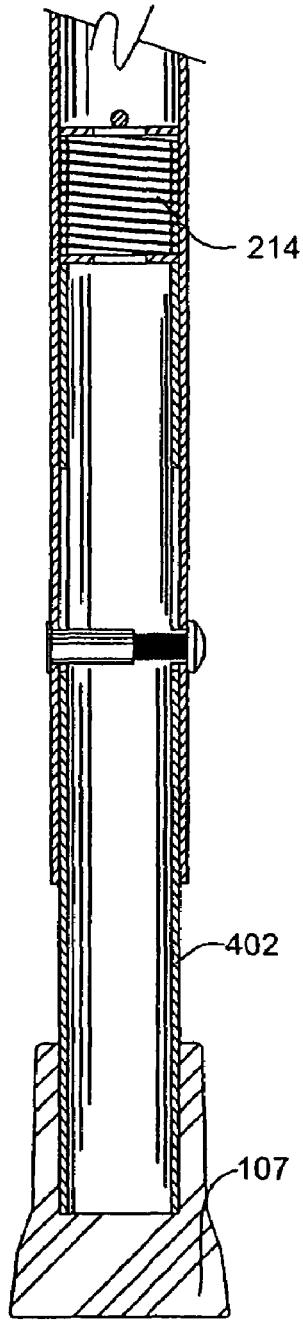
FIG. 14 is a cross-sectional side elevation view of an embodiment of the crutch shock absorbing mechanism in the compressed position.

A shock absorbing portion 106 may be included in an ergonomic collapsible crutch 100. FIGS. 1-4 and 8 illustrate a crutch 100 in an assembled position, where the crutch is ready for use by a user to provide assistance with ambulatory movement of the user. In one embodiment, a spring 214 is used to provide a shock absorbing mechanism, as illustrated in FIGS. 4, 12, 13 and 14. Alternative shock absorbing devices are possible, including but not limited to gas assisted shocks, hydraulic shocks and pneumatic shocks. The spring 214 is contained within the lower half of the adjustable portion 116. The proximal end of the spring 214 is held in place with a retaining pin 212 and an upper retaining washer 213. The distal end of the spring 214 contacts the proximal end portion of the shock bar 218 via a lower retaining washer 215. The shock bar 218 has a smaller external diameter than the internal diameter of the adjustable portion 116, such that the shock bar 218 can telescope into and out of the adjustable portion as required by the pressure exerted by a patient. A machine screw 216 connected with a tee nut 207 secures the adjustable portion 116 to the shock bar 218. The tee nut 207 extends through a longitudinally elongated aperture 401 in which the machine screw 216 connected with the tee nut 207 can slide. FIG. 13 illustrates a shock absorbing portion 106 in its relaxed state such that the spring 214 is extended. FIG. 14 illustrates a shock absorbing portion in its compressed state such that the spring 214 is compressed. The shock bar 218 is finished off at its end with a gripping pad 107 that acts as a support element on the ground. This pad 107 is made of the appropriate elastomeric material with its gripping surface ribbed, corrugated, spiked, or otherwise made to grip the surface to reduce friction. The pad is made such that the proximal portion of the pad fits onto the distal end of the crutch, with an articulation with the distal portion such that it can accommodate 120 degrees of motion. The articulation may include a hinge, ball in socket, sliding joint, or other means to allow for movement.

Figure 15:
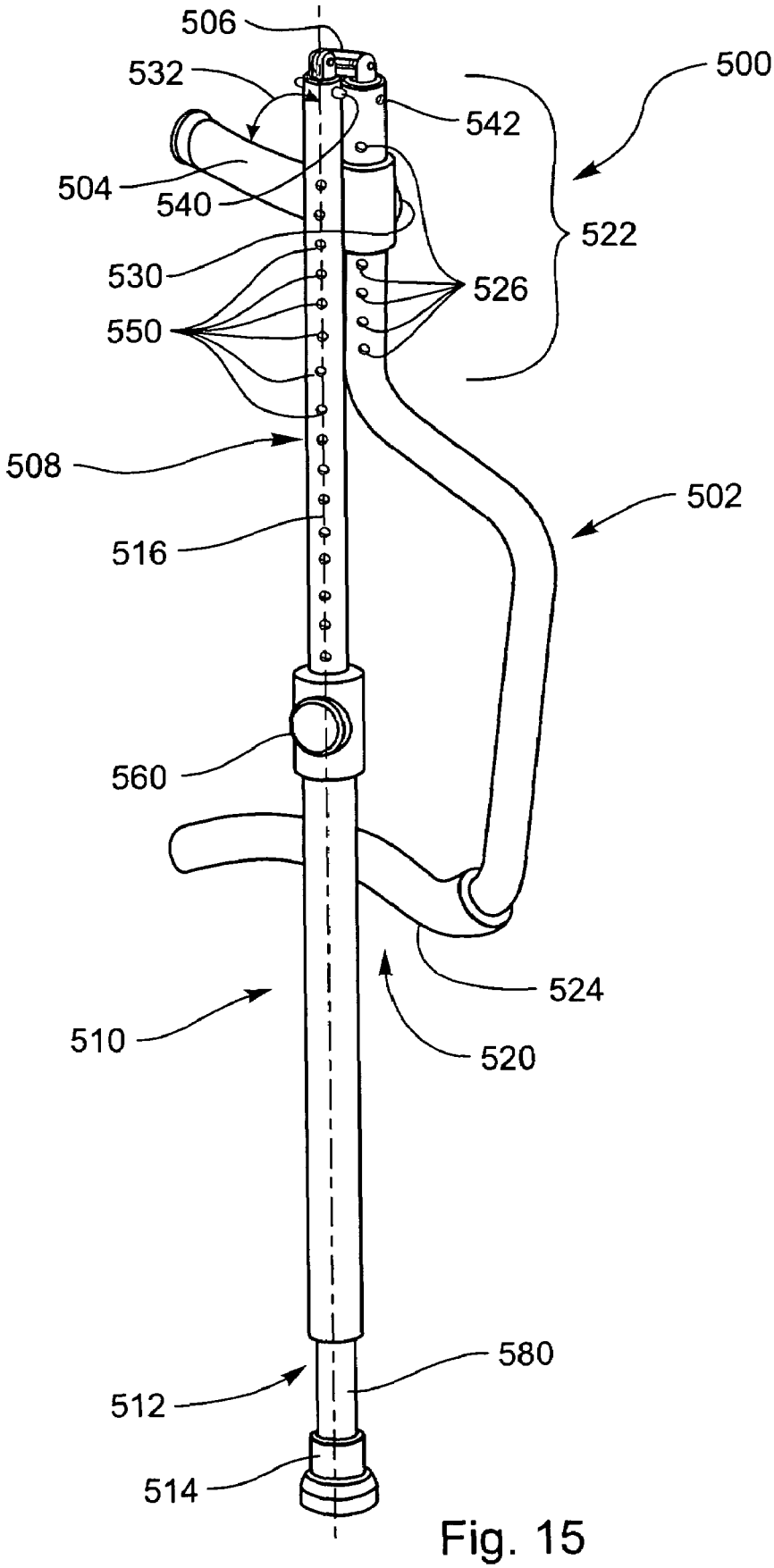
FIG. 15 is a perspective view of an alternative configuration of the crutch in a folded position.

FIGS. 15-19 discloses an alternative embodiment of a crutch 500. Referring to FIG. 15, a perspective view illustrates the crutch 500 in a folded position. The crutch 500 includes a supporting member 502, a hand grip 504, a linkage 506, an alignment rib 508, an adjustable portion 510, a shock absorbing device 512, and a gripping pad 514. A vertical axis extends through the alignment rib 508, the adjustable portion 510, the shock absorbing device 512, and the gripping pad 514. The weight of a user of the crutch 500 is channeled through the crutch 500 along the vertical axis 516 to a surface of a walking environment.

The supporting member includes an underarm support surface 520 and a hand grip portion 522. When in use by a user, the underarm support surface 520 provides support to and abuts the axilla of the user. The underarm support surface 520 includes a pad 524 that may be made of an elastomeric material. The pad 524 helps cushion weight of the user by spreading the weight of a user over a greater contact surface area.

The hand grip portion 522, as shown, is a straight bar or cylinder of the supporting member 502 oriented generally parallel to the vertical axis 516. The handgrip portion 522 includes a plurality of hand grip adjustment apertures 526. The hand grip 504 is removably attachable to the supporting member 502 at one of the plurality of hand grip adjustment apertures 526.

The hand grip 504 includes a button 530 that may be depressed to disengage a retaining device (shown in FIG. 16) from one or more of the plurality of hand grip adjustment apertures 526 for adjustment of the distance from the handgrip to the underarm support surface. When the button 530 is depressed by a user, the hand grip may be slid up and down the hand grip portion 522 of the supporting member 502. The user may then select a desired height for the hand grip 504 and release the button 530. Releasing the button 530 allows the retaining device (shown in FIG. 16) to engage and be seated within one of the hand grip adjustment apertures 526. Thus, attaching the hand grip 504 to the hand grip portion 522 for use by a user.

The hand grip 504 may be attached to the hand grip portion 522 so that the hand grip 504 extends from the supporting member 502 at an angle 532 from the vertical axis 516 ranging from about 85° to about 60° and from about 95° to about 120°. The hand grip 504 may also extend from the supporting member 502 at an angle from the vertical axis 516 ranging from about 80° to about 60° and from about 100° to about 120°. Alternatively, the hand grip 504 may extend from the supporting member 502 at an angle from the vertical axis ranging from about 80° to about 70° and from about 100° to about 110°.

The linkage 506 permits the crutch 500 to be folded into a more compact package. The linkage 506 is attached to the hand grip portion 522 of the supporting member 502 and the alignment rib 508. The linkage 506 allows the crutch to be easily assembled and disassembled while keeping the parts of the crutch 500 connected.

As shown, the alignment rib 508 is in a disassembled position. To place the alignment rib 508 in an assembled position, the alignment rib 508 is attached to the support member by moving the hand grip portion 522 of the supporting member 502 into alignment with the alignment rib 508. The alignment rib 508 and the hand grip portion 522 of the supporting member 502 are then forced together until a part of the alignment rib 508 is slid within the hand grip portion 522 of the supporting member 502 and a snap button 540 of the alignment rib 508 engages an assembly aperture 542 of the supporting member 502. The linkage 506 is substantially hidden from view within the crutch 500 while the alignment rib 508 is in the assembled position. The alignment rib 508 in an assembled position is similar to the alignment rib 115 of the crutch 100 as illustrated in FIGS. 1-4 and 8.

The alignment rib 508 in an assembled position extends from the support member 502 along the vertical axis 516 and the alignment rib 508 is disposable within the adjustable portion 510. The alignment rib 508 also includes a plurality of apertures 550, which allow the alignment rib 508 to be attached to the adjustable portion 510.

The adjustable portion 510 includes a button 560 that is similar to the button 530 of the hand grip 504. The button 560 is depressed to disengage a retaining device (shown in FIG. 17) from one or more apertures 550 for sliding adjustment of the distance between the gripping pad 514 and the underarm support 520.

The shock absorbing device 512 includes a shock bar 580 that is slidably attached to the adjustable portion 510. As a user uses the crutch 500, the shock absorbing device 512 cushions the impact of placing the crutch 500 onto a surface and as the user places his weight on the crutch 500.

The gripping pad 514 is shown attached to the shock bar 580 of the shock absorbing device 512. The gripping pad 514 is disposed remotely from the underarm support surface 520 generally along the vertical axis 516. The gripping pad 514 may be made of an elastomeric material to provide a high coefficient of friction to the bottom of the crutch 500 as well as to provide additional cushion to the impacts resulting from use of the crutch 500. A high coefficient of friction helps to prevent the crutch 500 from slipping on a surface, which may cause a user to fall resulting in injury. Thus, the gripping pad 514 is able to provide stability to a user and grip on surfaces of a walking environment.

Figure 16:
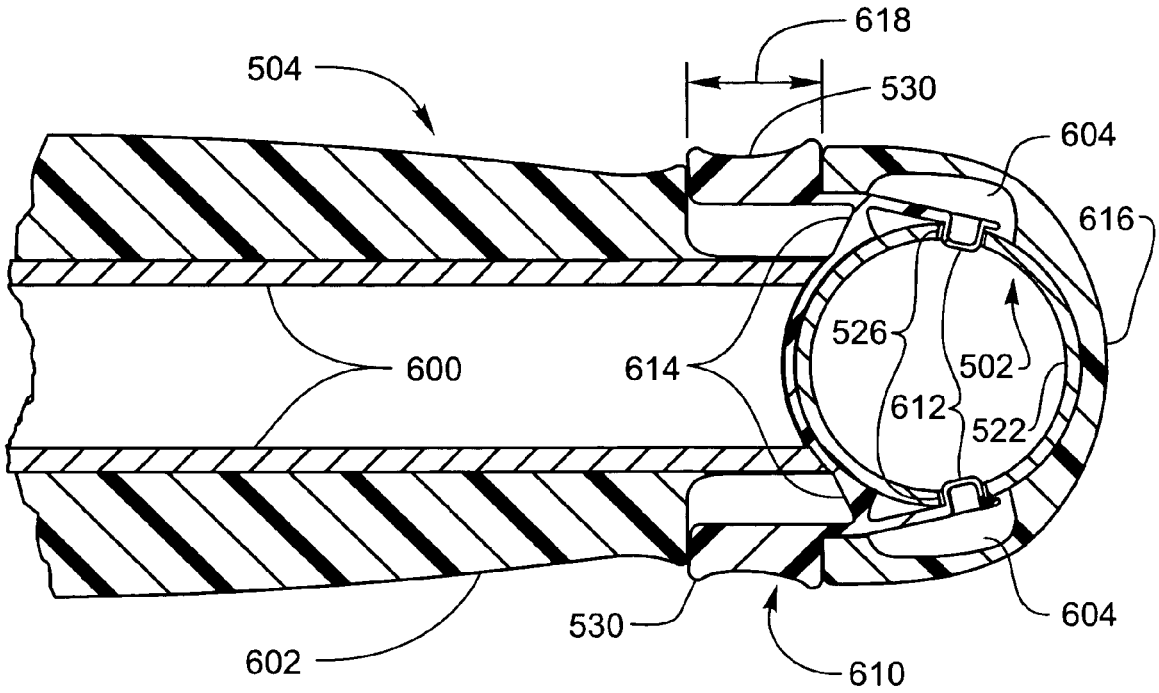
FIG. 16 is a cross-sectional view of the button of the hand grip shown in FIG. 15 along lines 16-16.

Referring to FIG. 16, a cross-sectional view illustrates the button 530 of the hand grip 504 of the crutch 500 along lines 16-16 in FIG. 15. As shown, the hand grip 504 includes a rigid core 600, a cover 602, and buttons 530. The rigid core 600 may be a round or oblong cylinder or a solid bar. The hand grip 504 also includes cavities 604.

The button 530 is part of an attachment mechanism 610 that includes retaining members 612 and pivots 614. Each button 530 is disposed opposite a retaining member 612 about the pivot 614. The attachment mechanism 610 is covered by an overmold 616 to protect the attachment mechanism from damage and contaminants that may affect its functionality. The overmold 616 also prevents the attachment mechanism 610 from being caught by clothing and interfering with the movement of a user. The buttons 530 may be coated with an elastomeric material or painted for aesthetics and protection as well as to increase the coefficient of friction to prevent a user's fingers from slipping off of the buttons 530.

The button 530 may have a greater diameter than about 0.5 inches. A large button diameter 618 facilitates adjustment by a user that may have arthritis, suffered a stroke, suffering from Parkinson's disease, or experienced some other event where the use of fine motor skills may be impaired. In some embodiments, the button diameter 618 may be greater than about 0.75 inches and in other configurations, the button 530 may have a diameter 618 greater than about 1 inch. The external positioning of the button 530 allows a user to detach a part such as the hand grip portion 522 from a tube positioned within the part.

As shown, the attachment mechanism 610 is a compliant mechanism where the two buttons 530, the two retaining members 612, and the two pivots 614 are integrally formed. The retaining members 612 are biased toward each other by the spring characteristics of the material of the attachment mechanism 610. Once the retaining members 612 are seated in the diametrically opposed hand grip adjustment apertures 526, the retaining members 612 are retained in the hand grip adjustment apertures 526 by the spring force of the attachment mechanism 610.

To remove and disengage the retaining members 612 from the hand grip adjustment apertures 526 of the hand grip portion 522, a user presses the buttons 530 toward each other. As the buttons 530 are depressed, the buttons 530 levers the retaining members 612 out of the hand grip adjustment apertures 526 to detach the hand grip 504 from the supporting member 502. By disposing the button 530 opposite the retaining member 612 about the pivot 614, the mechanical advantage of this lever arrangement may be used to reduce the force necessary to remove and disengage the retaining members 612 from the hand grip adjustment apertures 526. The retaining members 612 move into the cavities 604, to allow the hand grip 504 to slide over the hand grip portion 522 of the supporting member 502. Thus, the retaining members 612 are disengaged from the hand grip adjustment apertures 526 of the supporting member 502 for adjustment of the distance between the hand grip 504 and the underarm support 520.

It should be noted that the attachment mechanism 610 may be disposed opposite the hand grip 504 about the hand grip portion 522 of the supporting member 502.

Figure 17:
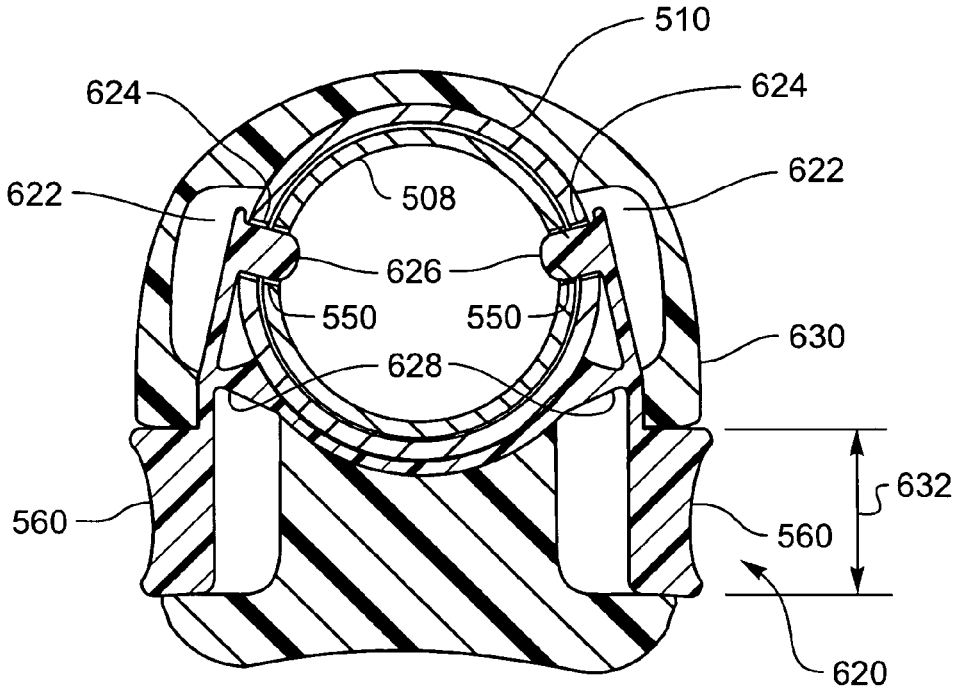
FIG. 17 is a cross-sectional view of the button of the adjustable portion shown in FIG. 15 along lines 17-17.

Referring to FIG. 17, a cross-sectional view illustrates the button 560 of the adjustable portion 510 of the crutch 500 along lines 17-17 in FIG. 15. As shown, the alignment rib 508 extends within and is attached to the adjustable portion 510 by an attachment mechanism 620 of the adjustable portion 510. The adjustable portion 510 also includes cavities 622 and access aperture 624.

Like the attachment mechanism 610 shown in FIG. 16, the attachment mechanism 620 similarly includes the buttons 560, retaining members 626, and pivots 628. Each button 560 is disposed opposite a retaining member 626 about the pivot 628. The attachment mechanism 620 is covered by an overmold 630 to protect the attachment mechanism from damage and contaminants that may affect its functionality. The overmold 630 also prevents the attachment mechanism 620 from being caught by clothing and interfering with the movement of a user. The buttons 560 may also be coated with an elastomeric material or painted for aesthetics and protection as well as to increase the coefficient of friction to prevent a user's fingers from slipping off of the buttons 560.

The button 560 may have a greater diameter than about 0.5 inches. A large button diameter 632 facilitates adjustment by a user that may have arthritis, suffered a stroke, suffering from Parkinson's disease, or experienced some other event where the use of fine motor skills may be impaired. In some embodiments, the button diameter 632 may be greater than about 0.75 inches and in other configurations, the button 560 may have a diameter 632 greater than about 1 inch. The external positioning of the button 560 allows a user to detach a part such as the adjustable portion 510 from a tube positioned within the part.

The attachment mechanism 620 is a compliant mechanism where the two buttons 560, the two retaining members 626, and the two pivots 628 are integrally formed. The retaining members 626 are biased toward each other by the spring characteristics of the material of the attachment mechanism 620. Once the retaining members 626 are seated in the diametrically opposed apertures 550 of the alignment rib 508, the retaining members 626 are retained in apertures 550 by the spring force resulting from the elastic deformation of the attachment mechanism 620.

To remove and disengage the retaining members 626 from the apertures 550 of the alignment rib 508 for adjustment of the distance between the supporting member 502 and the gripping pad 514, a user presses the buttons 560 toward each other. By disposing the button 560 opposite the retaining member 626 about the pivot 628, the mechanical advantage of this lever arrangement may be used to reduce the force necessary to remove and disengage the retaining members 626 from the apertures 550 of the alignment rib 508. As the buttons 560 are depressed, the buttons 560 levers the retaining members 626 out of the apertures 550 to detach alignment rib 508 from the adjustable portion 510. Thus, the retaining members 626 are disengaged from the apertures 550 of the alignment rib 508 for the slideable adjustment of the distance between the supporting member 502 and the gripping pad 514.

Figure 18:
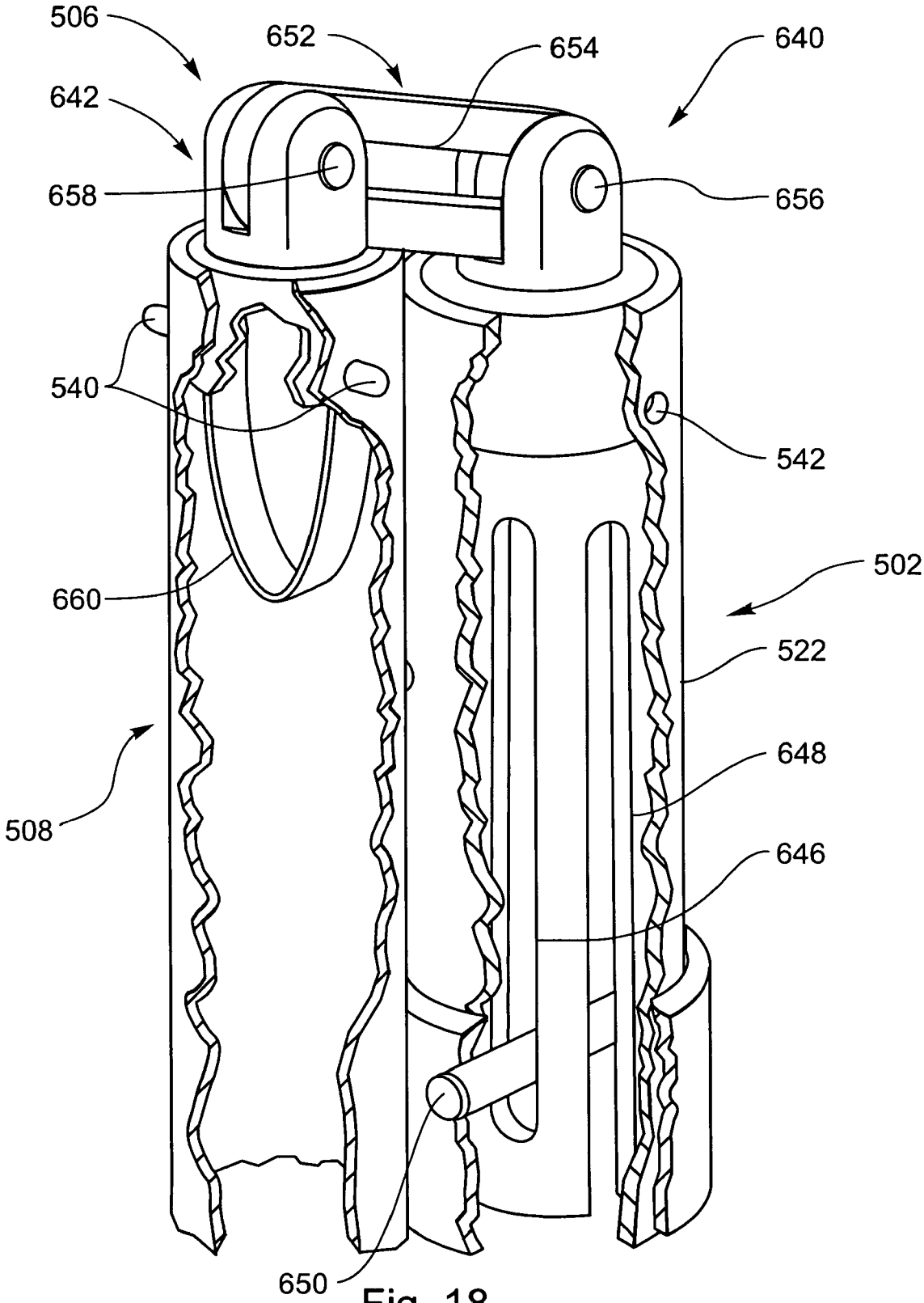
FIG. 18 is a perspective breakaway view of the linkage for collapsing the crutch shown in area 18-18 FIG. 15.

Referring to FIG. 18, a perspective breakaway view of the area 18-18 of FIG. 15 illustrates the linkage 506 attached to the alignment rib 508 and the hand grip portion 522 of the supporting member 502. The linkage 506 includes a first end 640 slidably attached to the hand grip portion 522 and a second end 642 attached to the alignment rib 508. The first end 640 includes an extended body 644 that includes diametrically opposed slots 646 and diametrically opposed elongated cutouts 648. A pin 650 extends through the slots 646 of the extended body 644 of the second end 642 and the hand grip portion 522 to slidably attach the first end 640 and the hand grip portion 522.

A bar 652 extends between the first end 640 and the second end 642 and has a slot 654 that is slidably and pivotally attached to the first end 640 and the second end 642 by pins 656 and 658 respectively. The bar 652 allows the supporting member 502 to be folded against the alignment rib 508 and/or the adjustable portion 510. The first end also includes the assembly aperture 542 that is engaged by the snap buttons 540 extending from the spring 660 when the alignment rib 508 is moved to the assembled position. When the alignment rib is in the assembled position, the linkage 652 is substantially hidden from view within the supporting member 502 of the crutch 500.

The elongated cutouts 648 of the first end 640, allow the hand grip 504 (shown in FIG. 15) to be attached to the hand grip portion 522 of the supporting member 502 without interfering with the function of the linkage 506. More specifically, as the linkage 506 slides within the hand grip portion 522 of the supporting member 502, elongated cutouts 648 allow the extended body 644 to slide around the retaining members 612 (shown in FIG. 16) of the hand grip 504 (shown in FIG. 16).

Figure 19:
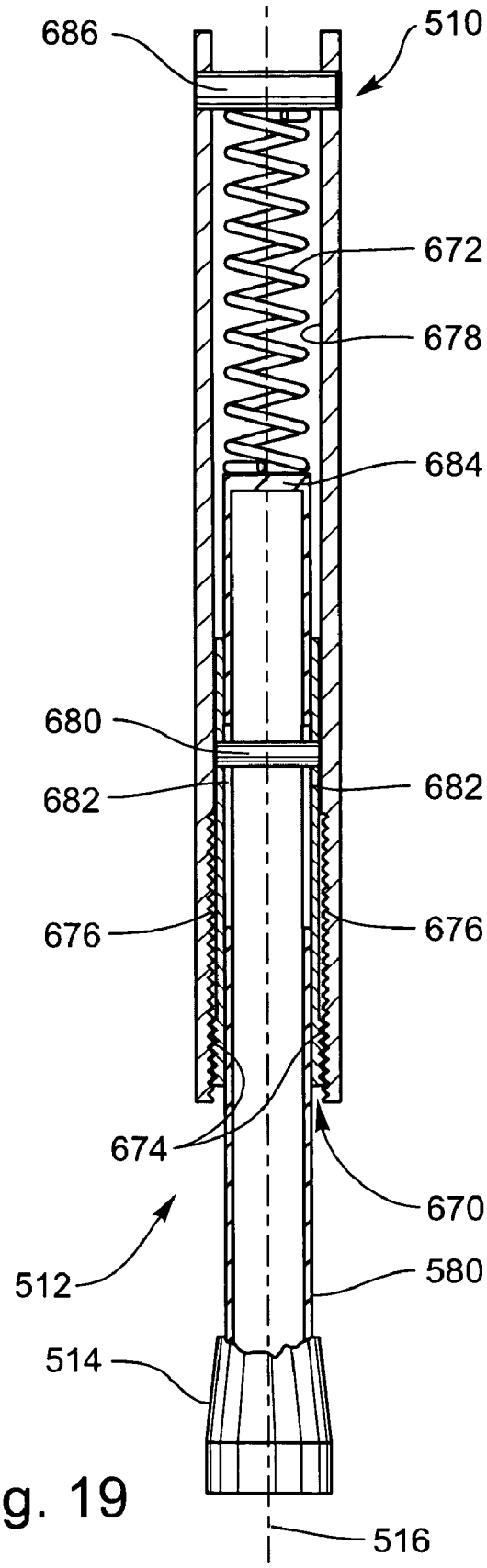
FIG. 19 is a cross-sectional view of the adjustable shock absorber along lines 19-19 of the crutch shown in FIG. 15.

Referring to FIG. 19, a cross-sectional view illustrates the adjustable shock absorber along lines 19-19 of the crutch 500 shown in FIG. 15. The shock absorbing device 512 may be disposed between the supporting member 502 and the gripping pad 514. In FIG. 19, the shock bar 580 of the shock absorbing device 512 is attached to the gripping pad 514 and extends into the adjustable portion 510.

The shock absorbing device 512 also includes a sleeve 670 and a spring 672. The sleeve 670 includes a thread 674 that engages a thread 676 that is connected to the supporting member. In different configurations, the thread 674 of the sleeve 670 may be external or internal. More precisely in this configuration, the thread 674 of the sleeve 670 is an external thread. The thread 676 is disposed on an internal surface 678 of the adjustable member 510, which is connected to the supporting member 502 through the alignment rib 508.

The shock bar 580 is slidably attached to the sleeve 670 by a guide pin 680 that extends through the sleeve 670 and through a longitudinally elongated aperture 682 of the shock bar 580. Therefore, shock bar 580 is able to slide the length of the longitudinally elongated aperture 682 less the diameter of the guide pin 680 within the sleeve 670. The shock bar 580 also includes rear plate 684 that may be coupled to or abut the spring 672. The other end of the spring 672 is positioned within the adjustable portion 510 by a retaining pin 686 extending through and attached to the adjustable portion 510.

The spring rate of the spring 672 is adjustable and thus, the shock absorbing device 512 is also adjustable. The spring rate of the spring 672 is adjusted as the shock bar 580 or the sleeve 670 is rotated within the adjustable portion 510. As the shock bar 580 or the sleeve 670 is rotated, the external threads 674 of the sleeve 670 engage the internal threads 676 of the adjustable portion 510 to move the sleeve 670 and the guide pin 680 along the vertical axis 516 within the adjustable portion 510.

As the guide pin 680 moves closer to the retaining pin 686, the spring 672 is compressed by the rear plate 684 of the shock bar 580. Thus, when the crutch 500 is used by a user, the shock absorbing device 512 is stiffer and provides a harder cushioning of the impacts resulting from use. Conversely, as the guide pin 680 moves further from the retaining pin 686, the spring 672 is decompressed. Thus, when the crutch 500 is used by a user, the shock absorbing device 512 provides a softer cushioning of the impacts resulting from use. Additionally, a bushing may be used around the shock bar 580 to slow the movement of the shock bar 580 within the sleeve 670.

Figure 20A:
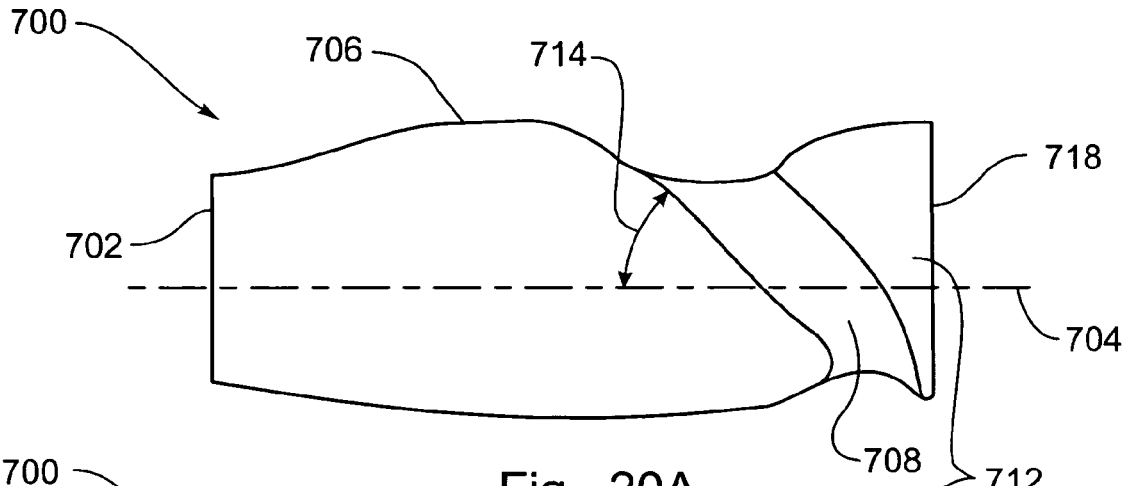
FIGS. 20A, 20B, and 20C are a side elevation view, a top view, and an opposite side elevation view of an alternative configuration of a hand grip.
Figure 20B:
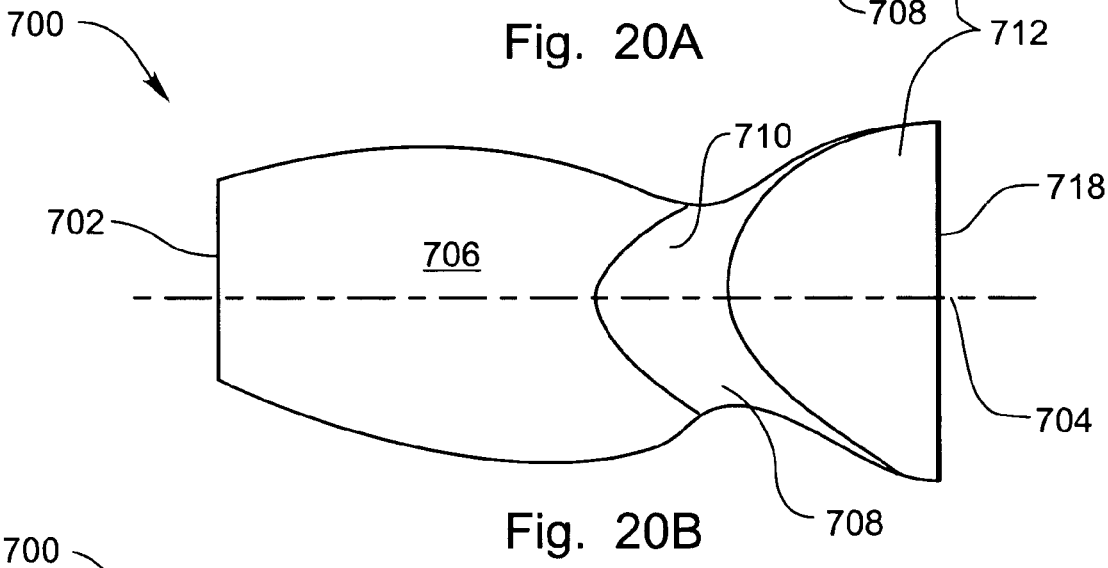
Figure 20C:
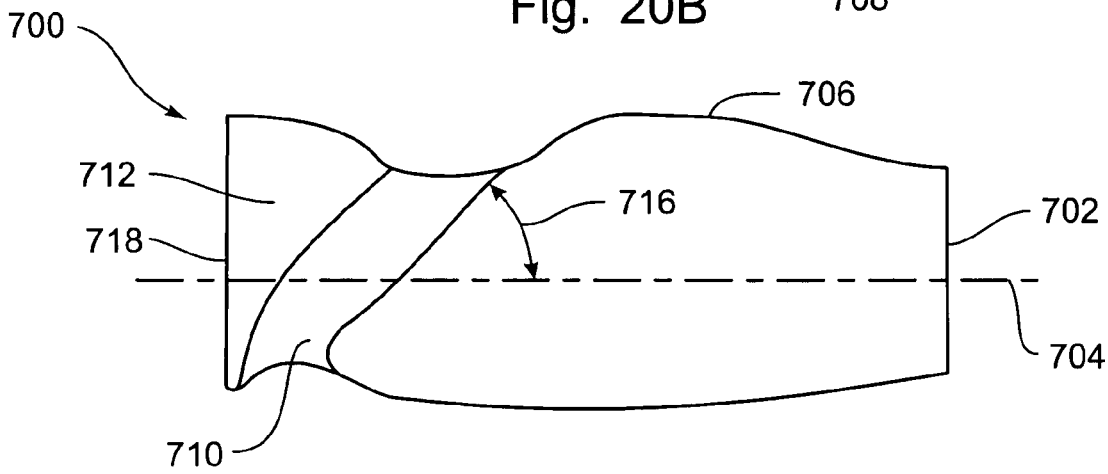

Referring to FIGS. 20A, 20B, and 20C, a side elevation view, a top view, and an opposite side elevation view illustrate an alternative hand grip 700 for use with the crutch 500 shown in FIG. 15. The hand grip 700 includes a base 702 for attachment directly to a supporting member (not shown) similar to the supporting member 102 shown in FIGS. 6 and 7 or attached to an attachment mechanism (not shown) similar to the attachment mechanism of FIG. 16. The hand grip 700 also includes a grip axis 704, a palm bulge 706, a forefinger groove 708, a thumb groove 710, and an end guard 712.

The forefinger groove 708 curves about the grip axis 704 at an angle 714 ranging from about 5° to about 75° from the grip axis 704. The forefinger groove 708 may also curve about the grip axis 704 at an angle 714 ranging from about 5° to about 85° from the grip axis 704. The thumb groove 710 curves about the grip axis 704 opposite the forefinger groove 708 at an angle 716 ranging from about 10° to about 75° from the grip axis 704. The thumb groove 710 may also curve about the grip axis 704 opposite the forefinger groove 708 at an angle 716 ranging from about 5° to about 85° from the grip axis 704. The end guard 712 helps to prevent a hand of a user from slipping off an end 718 of the hand grip 700. This ergonomic design of the hand grip 700 allows a user to grip the hand grip 700 with her hand in a natural and unstrained position.

The different elements of the invention may be applied to canes as well as arm crutches. An alternative to the using a button in attaching a supporting member to an alignment rib and an alignment rib to an adjustable portion is that the supporting member, alignment rib, and the adjustable portion may have the same outside diameter with a necked down portion that fits within an orifice of the part to be attached. The necked down portion and the orifice may be a press fit to prevent detachment of the parts.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A shock absorbing crutch, comprising:

a proximal end and a distal end;

a vertical axis;

a supporting member having a proximal end and a distal end, the supporting member comprising:

a generally horizontally oriented underarm support, the underarm support having a concave curvature along its top edge and a convex curvature along its bottom edge;

a stabilizing portion, the stabilizing portion extending downwardly from said horizontal underarm support at an angular orientation with respect to the underarm support in the range of 45° to 135°;

a middle bend portion projecting toward the vertical axis such that the middle bend portion is at an angular orientation with respect to the stabilizing portion in the range of 90° to 180°; and a generally vertically oriented hand grip portion, the hand grip portion containing a plurality of diametrically opposed apertures;

a hand grip attached to the handgrip portion of the supporting member;

a generally vertically oriented alignment rib having a proximal end and a distal end;

a folding section connecting the distal end of the supporting member to the proximal end of the alignment rib so that the crutch is foldable;

a generally vertically oriented adjustable portion, the adjustable portion having a proximal end and a distal end;

a shock absorbing device located within the distal end of the adjustable portion; and a gripping pad;

wherein the hand grip attached to the supporting member such that is extends outwardly and downwardly from the supporting member at an angle ranging from about 10° to about 30° below horizontal.

2. An ergonomic crutch, comprising:

a supporting member, wherein the supporting member has a proximal end, a distal end and a hollow interior, wherein the supporting member is configured to provide:

a generally horizontally oriented underarm support at the supporting member proximal end, the underarm support having a concave curvature along its top edge and a convex curvature along its bottom edge, the underarm support having an underarm support pad fabricated of elastomeric material, a stabilizing portion, the stabilizing portion extending downwardly from said horizontal underarm support at an angular orientation with respect to the underarm support in the range of 45° to 135°, a middle bend portion projecting toward the crutch distal end such that the middle bend portion is at an angular orientation with respect to the stabilizing portion in the range of 90° to 180°, a generally vertically oriented hand grip portion, wherein the hand grip portion is at the distal end of the supporting member, the hand grip portion containing a plurality of diametrically opposed apertures a hand grip attached to the supporting member; and a hand grip extending outwardly and downwardly from the supporting member at an angle of at least about 10° below horizontal such that the wrist of a user is generally maintained in a neutral position wherein the user's third metacarpal is generally aligned with the user's radius.

3. The ergonomic crutch of claim 2, wherein the hand grip is adjustable.

4. The ergonomic crutch of claim 2, wherein the crutch further comprises a folding section.

* * * * *